US005668921A

United States Patent [19]

Essler

[11] Patent Number: 5,668,921

[45] Date of Patent: Sep. 16, 1997

[54] HOT-AIR DRYER WITH INFRARED HEATER AND SLIT-SHAPED OUTLET

[76] Inventor: Karl-Hermann Essler, Koppeldamm 20, D-25436 Tornesch, Germany

[21] Appl. No.: 543,186

[22] Filed: Oct. 13, 1995

[30] Foreign Application Priority Data

Oct. 14, 1994 [DE] Germany ..... 44 36 713.9

[51] Int. Cl.[6] ..... A61H 33/08

[52] U.S. Cl. ..... 392/379; 392/407; 392/423; 392/380

[58] Field of Search ..... 392/379–385, 392/363, 367, 417, 407, 423–425; 219/388, 85.12, 85.13; 34/632, 633, 636, 638, 639, 653, 655, 90, 91, 266–274, 283; 53/370.7, 370.9, 373.7, 373.9, 375.9, 377.7; 156/272.2, 499

[56] References Cited

U.S. PATENT DOCUMENTS

| | | | |
|---|---|---|---|
| 2,941,062 | 6/1960 | Halley | 392/379 |
| 3,247,383 | 4/1966 | Ulseth et al. | 392/423 |
| 3,621,198 | 11/1971 | Herbrich | 219/85.12 |
| 3,649,811 | 3/1972 | Schoenthaler | 392/424 |
| 3,760,152 | 9/1973 | Saito et al. | 392/417 |
| 3,956,612 | 5/1976 | Ballard et al. | 392/417 |
| 4,384,914 | 5/1983 | Mattiebe | 53/373.9 |
| 4,854,052 | 8/1989 | Korpela | 34/68 |
| 5,092,059 | 3/1992 | Wimberger et al. | 34/641 |
| 5,099,586 | 3/1992 | Anderson | 34/68 |
| 5,254,166 | 10/1993 | Tu | 34/638 |
| 5,440,821 | 8/1995 | Hamrin | 34/267 |

FOREIGN PATENT DOCUMENTS

| | | | |
|---|---|---|---|
| 1353495 | 1/1964 | France | 392/423 |
| 752400 | 6/1953 | Germany | 392/423 |
| 2351280 | 5/1975 | Germany | 34/267 |
| 1703930 | 1/1992 | U.S.S.R. | 34/266 |
| 8800989 | 2/1988 | WIPO | 156/272.2 |

*Primary Examiner*—Tu B. Hoang
*Attorney, Agent, or Firm*—Herbert Dubno

[57] ABSTRACT

An elongated housing has a pair of radiation-transparent strips defining a slit from which hot air is directed at an article to be dried. The air passes over a radiant heater in the housing parallel to the slit and preferably through holes in a reflector which reflects radiation from the radiant heater toward the radiation-transmissive strips.

18 Claims, 6 Drawing Sheets

HOT-AIR DRYER WITH INFRARED HEATER AND SLIT-SHAPED OUTLET

SPECIFICATION

1. Field of the Invention

My present invention relates to a hot-air dryer with an infrared irradiator. More particularly, the invention relates to an apparatus for the drying of an article, e.g. a coated web of a flexible material, lacquered objects on a conveyor line, or other articles.

2. Background of the Invention

In the drying of high-gloss papers and particle board or other generally flat objects or webs of flexible material and in the drying of lacquer on painted or printed articles such as small containers like toothpaste tubes and in other applications where water-based coating or organic solvent coating must be dry, hot-air dryers are commonly used. Such dryers provide housings with plenums formed with slit-like nozzles for directing hot air onto the article to be dried. It is not uncommon for the hot-air system to be accompanied by an infrared heating of the articles from infrared irradiators disposed separate from and possibly proximal to the hot-air nozzle units so that the articles are heated by both the hot air and the infrared irradiation trained upon the articles so that the water or organic solvent can be evaporated.

The hot air is generally heated at a central location and transported by a duct system to the housings provided with the slit-type nozzles.

There are also units provided with slit-type nozzles into which a heating system is integrated to avoid the thermal losses of lengthy duct work. In this manner energy losses can be limited and a saving in cost can be gained. Such apparatus, however, is comparatively bulky and thus can take up an excessive amount of space. The spatial requirements are considerable in part because the infrared heaters which are used generally must be provided with coolers so that the supports for heat-generating coils and the coils themselves will not be damaged by the heat evolved by such heating units.

OBJECTS OF THE INVENTION

It is the principal object of the present invention to provide a heating unit with low spatial requirements which can provide drying of articles of the type described, by way of example, in an economical manner.

It is another object of the invention to provide an improved heater for the hot-air drying of articles which can be constructed more economically than earlier heating units.

Still another object of this invention is to provide an improved hot-air dryer which is free from drawbacks of earlier systems.

SUMMARY OF THE INVENTION

These objects and others which will become apparent hereinafter are attained by incorporating in the housing and particularly in the plenum of a housing communicating with a slit of a hot-air blower, an infrared irradiator which at least in part can serve to heat the hot air discharged by the nozzle toward the articles to be dried. More particularly, the dryer of the invention can comprise a housing, preferably an elongated housing, having a slit which can extend in the longitudinal dimension of the housing and communicates with a plenum thereof supplied with air, e.g. via a blower. The infrared irradiator may be an infrared lamp within the housing or another elongated infrared source extending advantageously the full length of that slit.

As a consequence, the air can be heated within the housing or, stated otherwise, the hot air can be generated within the housing and infrared irradiation from the housing may also be directed onto the article or articles to be dried. In this case, the slit can be defined between walls which are transparent or at least permeable to the radiation so that the infrared irradiation radiantly transmitted to the articles may provide most of the heat required to dry the latter, the balance of the thermal energy being supplied to the articles by the heated air. The air, as it is heated by conduction from the infrared irradiator, serves as a coolant in the latter.

It will be apparent that practically all of the thermal energy generated in the system is thus utilized for drying purposes and there are practically no losses since there is no ductwork through which heated air must travel according to the invention. The apparatus of the invention requires little space and for a large number of slits can occupy relatively little space.

The housings may be disposed adjacent one another so that a multiplicity of relatively closely-spaced parallel slits are provided and two or more longitudinally-extending slits can be provided in a single housing with at least one infrared heater and preferably an infrared heater per slit. The housings may be provided in series as well, connected to a common source of the air.

According to a feature of the invention, the walls of radiation permeable material are composed of quartz glass and may be provided with a coating which controls the radiation permeability thereof. They may be provided of a material which is darkenable as may be desired for such control.

Preferably the or each nozzle is defined between walls which are inclined to one another and a flange in the direction of flow of the air stream through the nozzles and the edges of these walls may be beveled so that the edges are parallel to one another at the nozzles. The nozzles may be defined by metallic mouthpieces which can be attached to the quartz plates forming the walls to minimize potential damage to the walls at the slit.

According to another invention, the side of the or each infrared irradiator turned away from the respective slit is juxtaposed with a reflector which can extend the entire length of the infrared irradiator and can be provided with radial bores, and, if desired, also tangential bores to distribute the air flow over the infrared irradiators.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
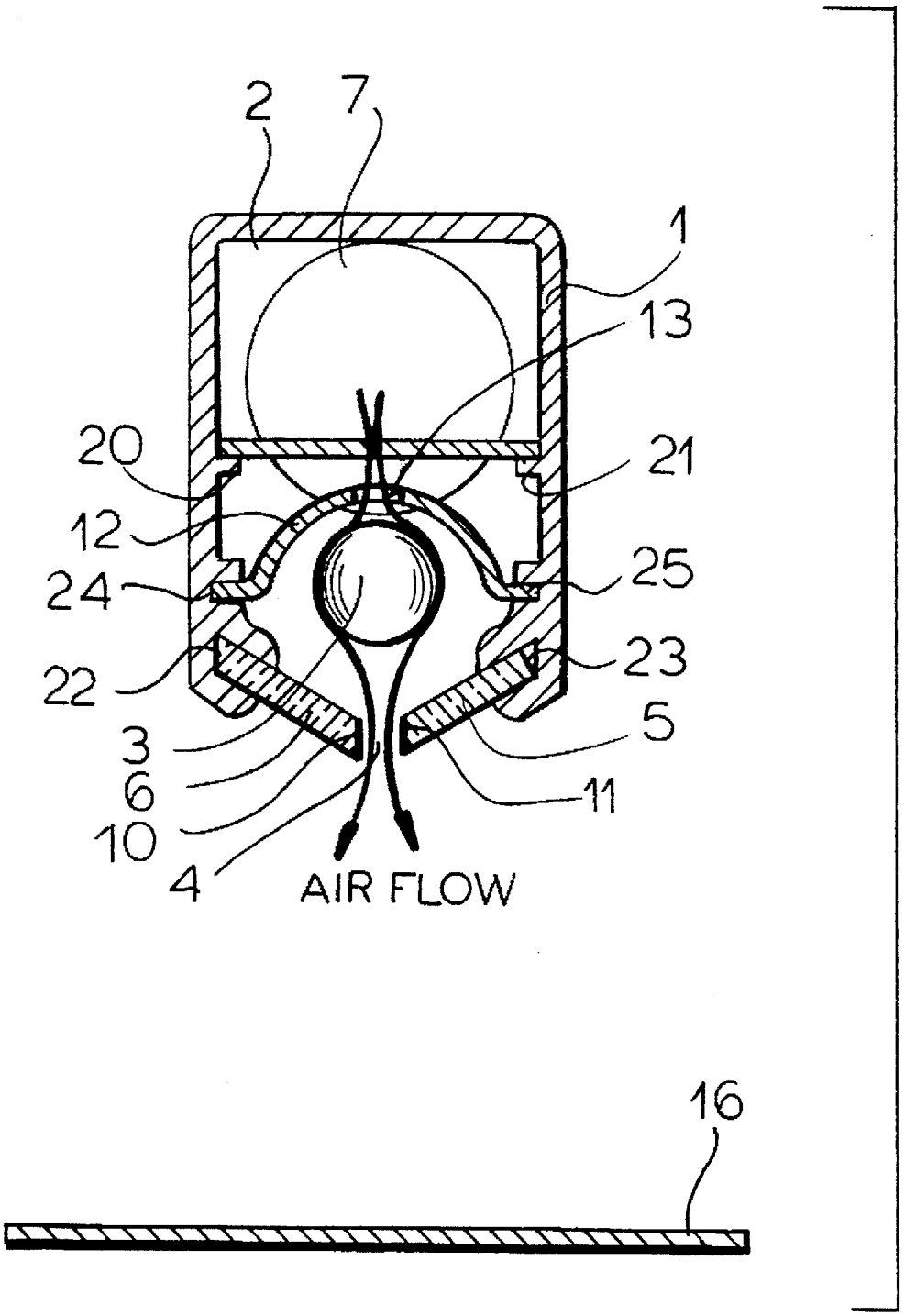
FIG. 1 is a transverse section through a housing according to the invention of a drying device.

As can be seen from FIG. 1, the dryer of the invention comprises an elongated box-like housing i in the interior of which a plenum 2 is formed and in which, extending in the longitudinal direction, an infrared radiator 3 in the form of a bar or lamp is provided. The radiant heater 3 is mounted in the ends of the housing above two strips 5, 6 of radiation-permeable material such as quartz, between which the slit nozzle 4 is formed.

The housing 1 is provided with an air-feeding port or duct 7 and with air-guide baffles 8, 9 which uniformly distribute the air flowing into the housing from one or both ends, substantially uniformly to the slit 4.

The baffles 8, 9 are mounted on ledges 20 and 21 projecting inwardly from the longitudinal walls of the housing. The housing may be extruded from, for example, aluminum or some other light metal.

The strips 5 and 6 are received in grooves 22 and 23 of the longitudinal walls of the housing 1 toward the bottom thereof and are inclined downwardly at an obtuse angle defining the slit 4 by beveled edges 10 and 11 which are parallel to one another.

The infrared radiator 3 extends over the entire length of the nozzle 4 and is covered, on its side opposite the slit 4, by a reflector 12 which has laterally-extending flanges engaged in slots 24 and 25 of the longitudinal walls of the housing. The radiant energy emitted by the radiator 3 in directions away from the slit 4 are reflected by the reflector 12 in the direction of the radiation-transparent strips 5 and 6.

Figure 2:
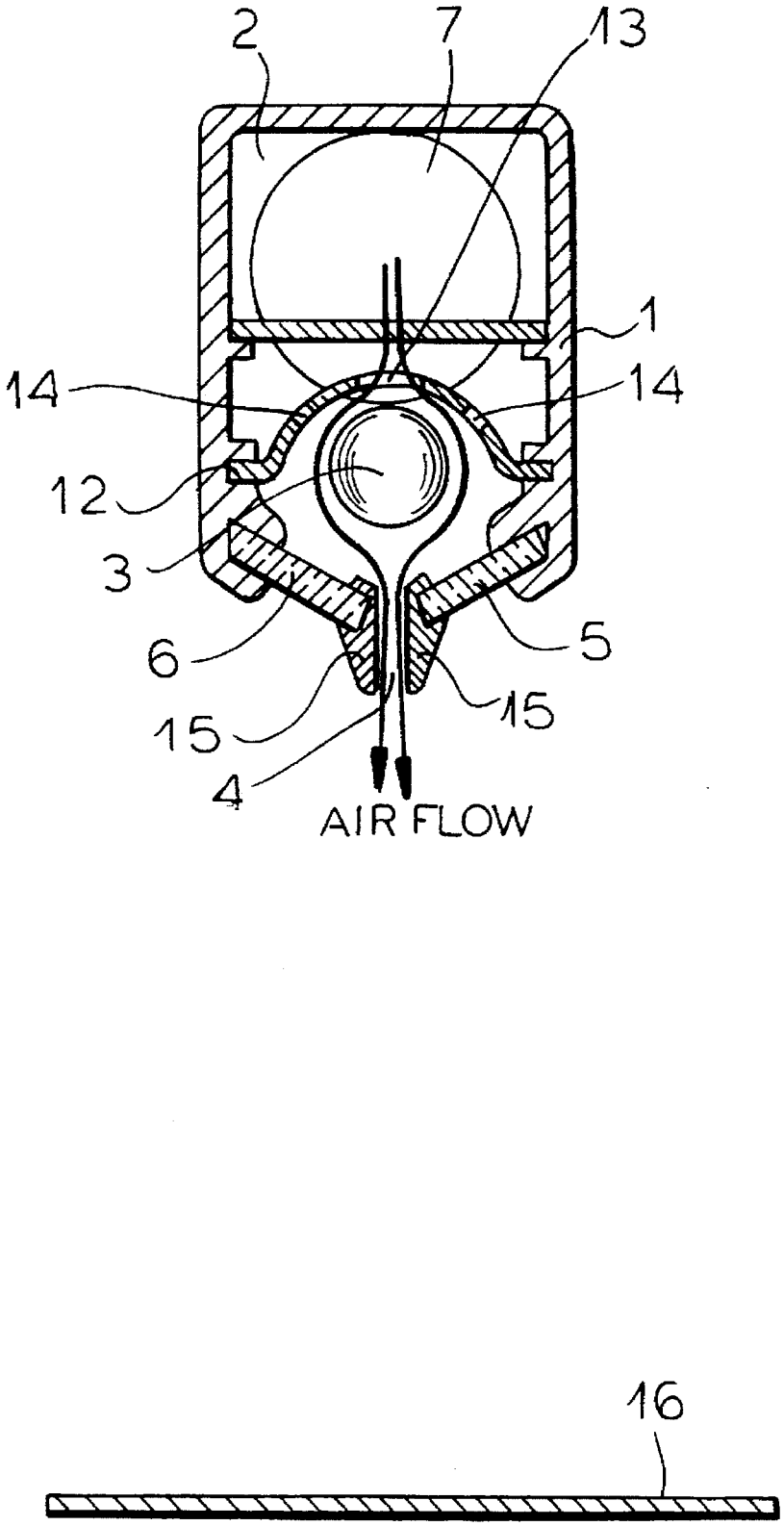
FIG. 2 is a view similar to FIG. 1 illustrating another embodiment.

The reflector 12 is provided with bores 13 which can be radial bores as shown in FIG. 1 but can include tangential bores 14 as illustrated in FIG. 2, if desired. The greater number of bores, of course, increases the air throughput through the reflector. As can be seen in FIG. 2, the slit 4 may be defined between parallel walls of a metal mouthpiece 15 mounted on the breakage-sensitive material of the strips 5 and 6. The use of the metal pieces 15 though avoids the need to bevel the edges 10, 11 of the quartz strips 5, 6.

Figure 3:
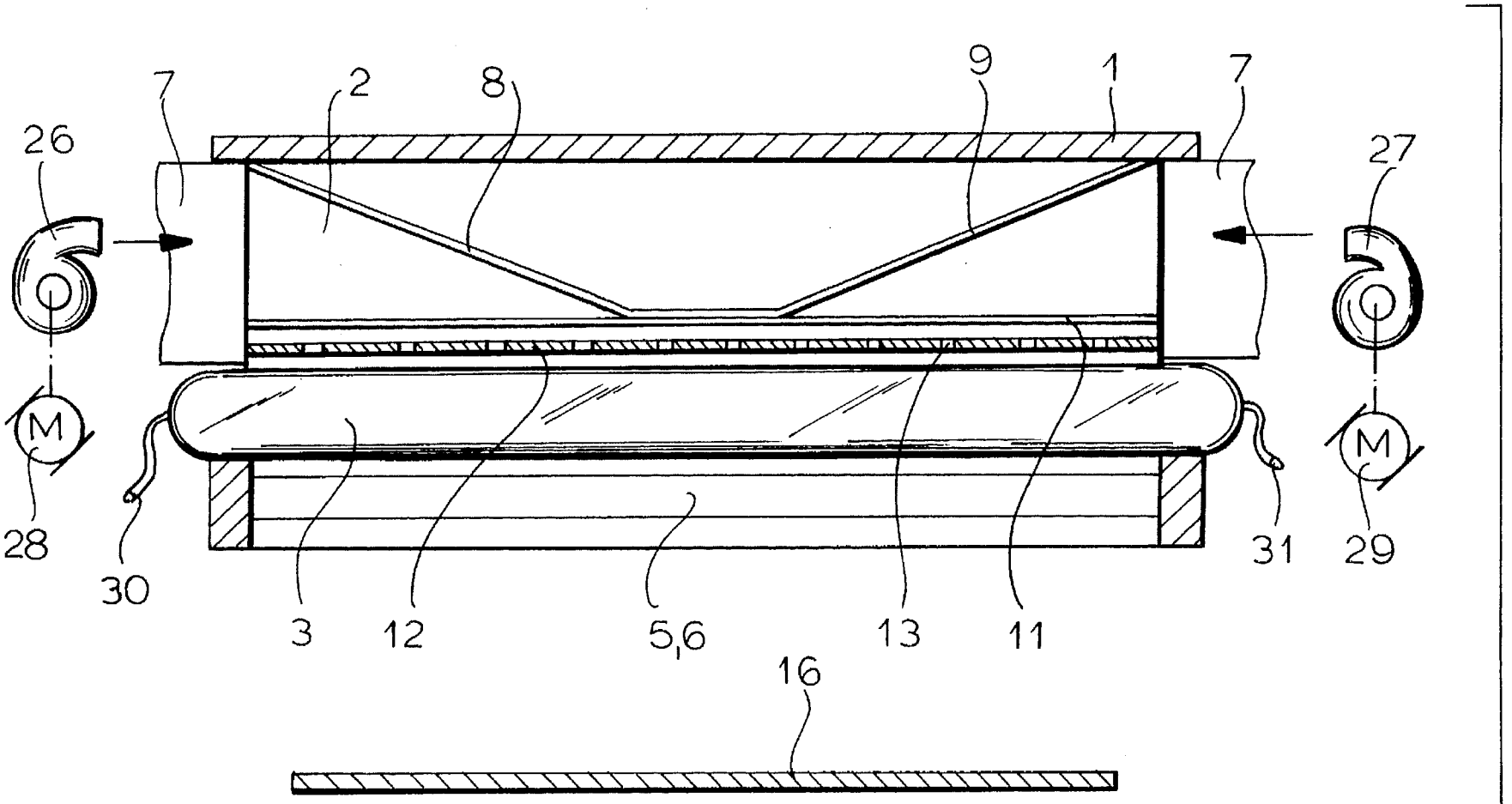
FIG. 3 is a longitudinal section through the device of FIG. 1.

As can be seen from FIG. 3, the housing I may receive air from blowers 26 and 27 driven by electric motors 28 and 29 and the radiant heater 3 may be energized through conductors 30 and 31.

In operation, ambient air is supplied by the blowers directly or through a duct system to both ends of the elongated housing 1, the air being uniformly distributed by baffles 8, 9 in the upper part of the plenum 2 to the slit 4 through the perforations 13, 14 in the reflector 12. The air flows out of the nozzle 4 in a sheet, heated by the infrared heater 3, onto the article 16 to be dried.

In addition thermal energy from the radiant heater 3 is transmitted directly or after reflection by the reflector 12 through the slit 4 and through the radiation permeable strips 5, 6 to additionally heat the article 16. The radiant heater is cooled by the flow of air across it.

Figure 4:
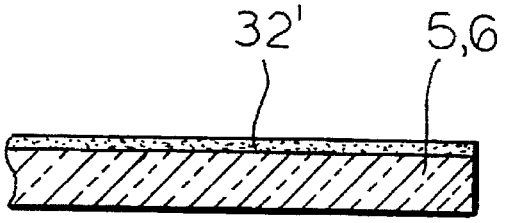
FIG. 4 is a section through a radiation-permeable wall provided with a coating.

The heat output of the device can be controlled by a power controller for the infrared heater 3. Frequently it is desirable to control the radiant energy transmitted by the strip 5 or 6 by applying a coating 32 to the flat strip as shown in FIG. 4. The coating can vary the radiation-transmissivity of the strip.

Figure 5:
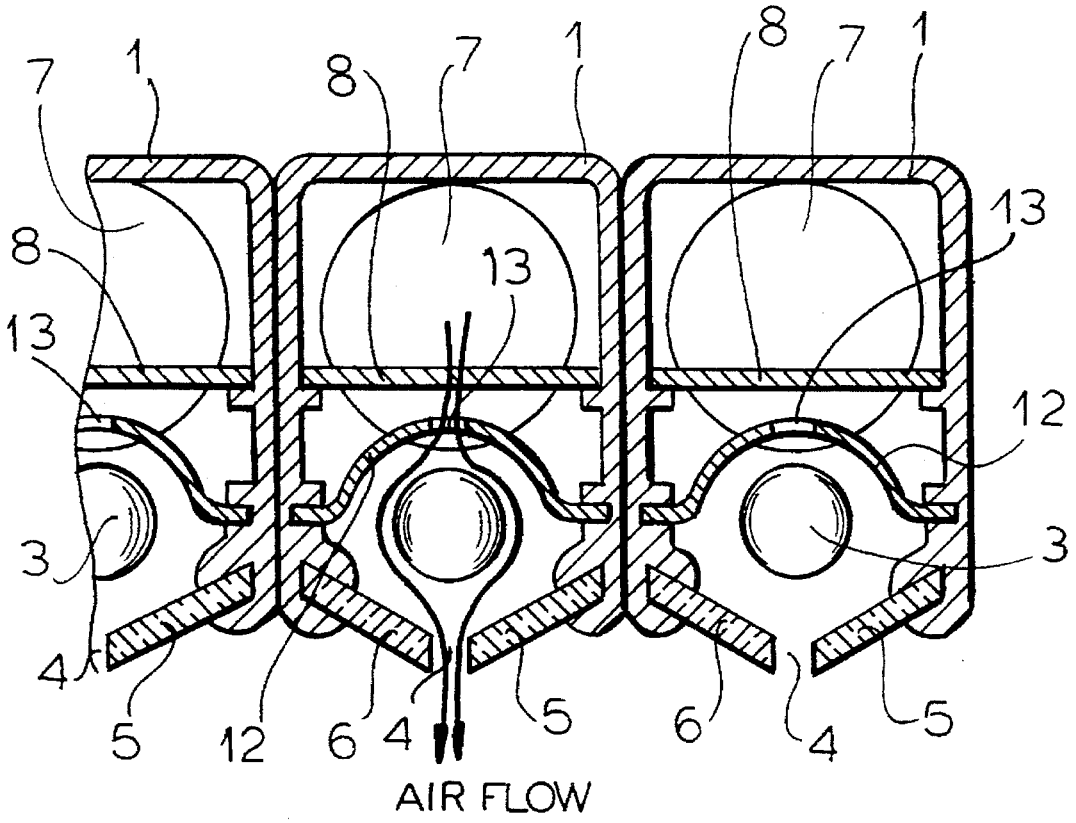
FIG. 5 is a view of an apparatus in accordance with the invention having a multiplicity of slits.

The apparatus of the invention can be used even in explosive environments since the infrared heater can be a sealed lamp and can be enclosed fully in the housing except for the slit 4. By an appropriate air speed through the housing, penetration of solvent vapors or ambient air containing solvent vapors can be prevented from entering the housing and contacting the heater. The device need not be operated only with air and, for example, noncombustible gases can be used like nitrogen. It will be understood that the invention is applicable to a dryer having two or more longitudinally-extending nozzles as can be seen, for example, in FIG. 5 in which a number of units like that of FIG. 1 can be disposed in side-by-side relationship to direct sheets of hot air from the slits 4.

Figure 6:
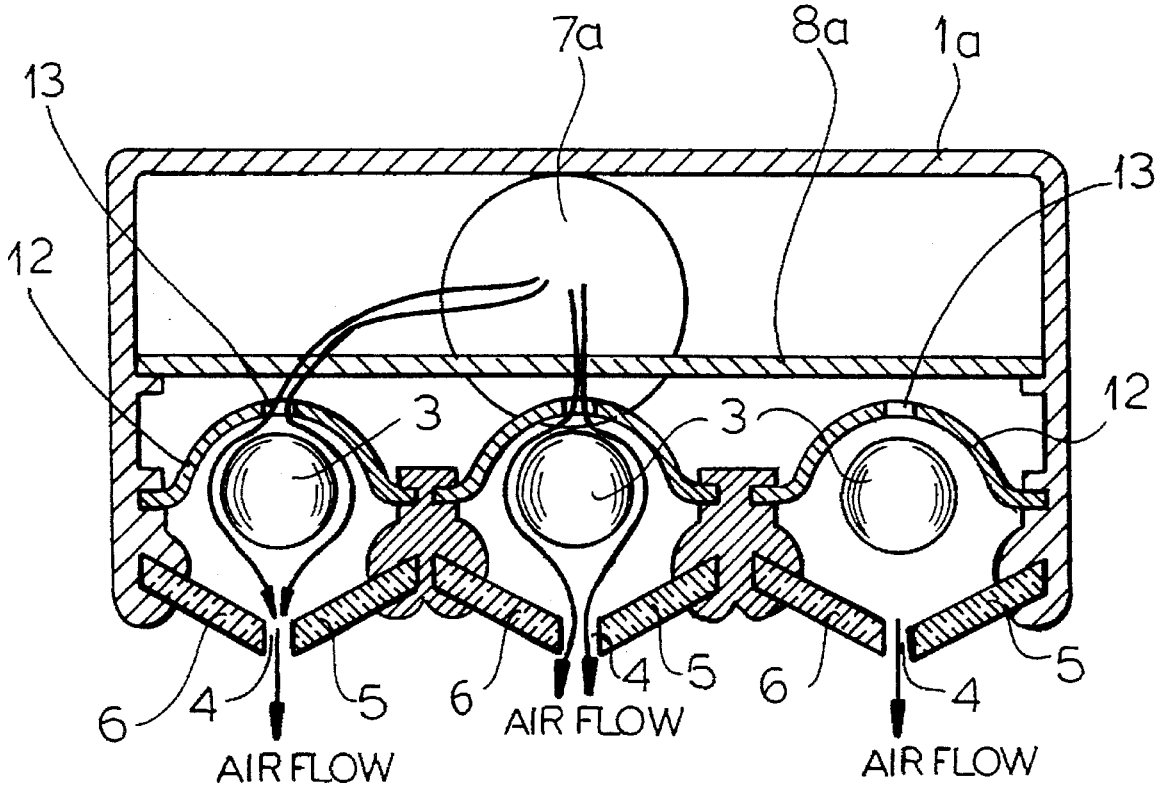
FIG. 6 is a view similar to FIG. 5 but illustrating another embodiment.

In FIG. 6 I show an embodiment of the invention in which the housing 1*a* has a plurality of slits 4 defined between respective pairs of quartz strips 5, 6, but a single inlet 7*a* at each end of the housing to distribute the air to the respective slits via the baffles 8*a*, for example, and the perforations in the reflectors 12 associated with each infrared heater 3.

Figure 7:
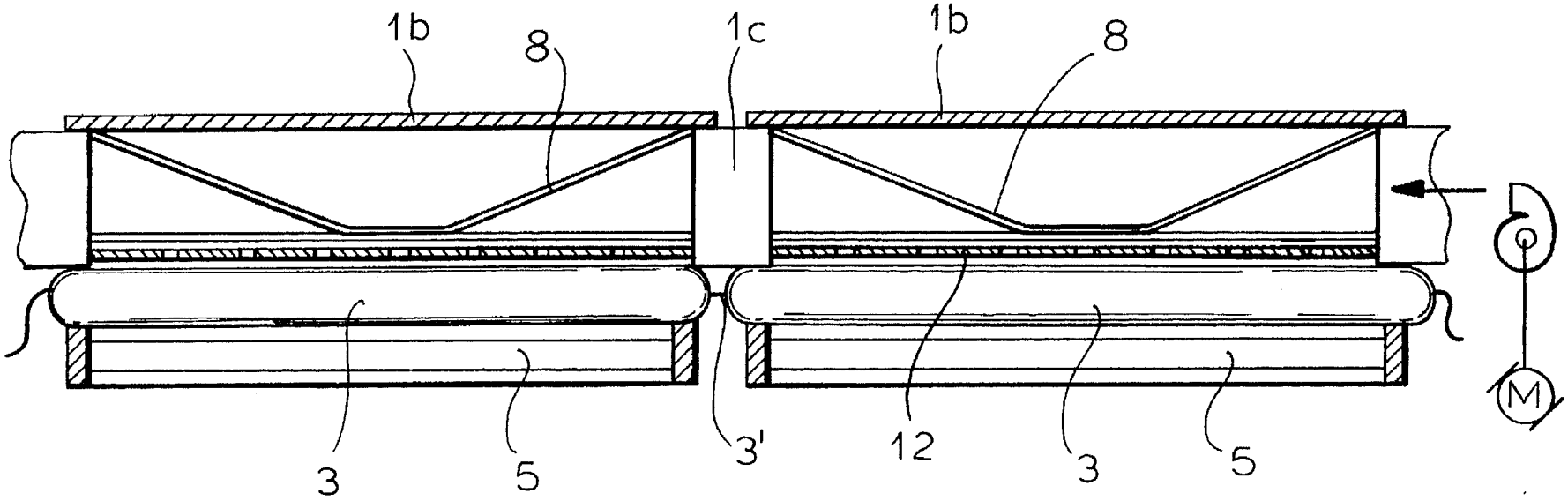
FIG. 7 is a longitudinal section of a system having a multiplicity of units disposed one after another in accordance with another feature of the invention.

FIG. 7 shows, further, that a plurality of such housings 1*b* can be joined together in succession via, for example, duct segments 1*c* and there heaters 3 can be connected in series at 3' when desired.

I claim:

1. An apparatus for drying an article comprising:

a housing forming an elongated plenum formed with a slit opening toward an article to be dried;

means for feeding drying air to said plenum whereby said article is treated with warm air emerging from said slit;

an infrared irradiator in said housing, said slit extending along a longitudinal dimension of said slit and said infrared irradiator being elongated and extends in said housing along said slit, said slit being defined between two walls composed of radiation-permeable material whereby said article is exposed to radiation from said infrared irradiator through said walls and said air by combustion before said warm air passes through said slit.

2. The apparatus defined in claim 1 wherein said housing is formed with a plurality of said slits.

3. The apparatus defined in claim 2 wherein each of said slits is provided with a respective infrared irradiator.

4. The apparatus defined in claim 1 wherein the radiation-permeable material is a quartz glass.

5. The apparatus defined in claim 1, further comprising a coating on said radiation-permeable material for controlling radiation transparency thereof.

6. The apparatus defined in claim 1 wherein said radiation-permeable material is a darkenable material.

7. The apparatus defined in claim 1 wherein said walls are inclined at an angle to one another and converging toward said slit.

8. The apparatus defined in claim 7 wherein said walls have beveled edges which are parallel to one another at said slit.

9. The apparatus defined in claim 7, further comprising a metallic slit-forming mouth mounted on said walls.

10. The apparatus defined in claim 1, further comprising a reflector extending along said infrared irradiator length thereof on a side of said infrared-irradiator turned away from said slit.

11. An apparatus for drying an article comprising:

a housing forming an elongated plenum formed with a slit opening toward an article to be dried;

means for feeding drying air to said plenum whereby said article is treated with warm air emerging from said slit;

an infrared-irradiator in said housing and a reflector extending along said infrared-irradiator over an entire length thereof on a side of said infrared-irradiator turned away from said slit, said reflector being provided with throughgoing bores oriented radially to said infrared-irradiator.

12. The apparatus defined in claim 11 wherein said reflector has further bores oriented tangentially to said infrared-irradiator.

13. The apparatus defined in claim 12 wherein said slit extends along a longitudinal dimension of said slit and said infrared-irradiator is elongated and extends in said housing along said slit.

14. The apparatus defined in claim 13 wherein said slit is defined between two walls composed of radiation-permeable material.

15. The apparatus defined in claim 14 wherein the radiation-permeable material is a quartz glass.

16. The apparatus defined in claim 15, further comprising a coating on said radiation-permeable material for controlling radiation transparency thereof.

17. The apparatus defined in claim 16 wherein said radiation-permeable material is a darkenable material.

18. The apparatus defined in claim 1, wherein a plurality of said housings with respective slits and infrared irradiators are provided in series.

* * * * *